US009543697B2

(12) United States Patent
Nakashima et al.

(10) Patent No.: US 9,543,697 B2
(45) Date of Patent: Jan. 10, 2017

(54) CONNECTOR HAVING A HOUSING WITH A FITTING TUBE WITH GUIDE WALLS WITH A LOCK ARM INBETTWEEN

(71) Applicant: Sumitomo Wiring Systems, Ltd., Yokkaichi, Mie (JP)

(72) Inventors: Akira Nakashima, Mie (JP); Norihito Hashimoto, Mie (JP); Shigeto Kataoka, Mie (JP); Naotaka Tanikawa, Mie (JP); Hideto Nakamura, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 14/787,517

(22) PCT Filed: May 8, 2013

(86) PCT No.: PCT/JP2013/062976

§ 371 (c)(1),
(2) Date: Oct. 28, 2015

(87) PCT Pub. No.: WO2014/181415

PCT Pub. Date: Nov. 13, 2014

(65) Prior Publication Data

US 2016/0079703 A1 Mar. 17, 2016

(51) Int. Cl.
*H01R 13/627* (2006.01)
*H01R 13/641* (2006.01)
*H01R 13/639* (2006.01)

(52) U.S. Cl.
CPC ..... *H01R 13/6272* (2013.01); *H01R 13/641* (2013.01); *H01R 13/639* (2013.01)

(58) Field of Classification Search
CPC ... H01R 13/62; H01R 13/627; H01R 13/6272; H01R 13/6275

(Continued)

(56) References Cited

U.S. PATENT DOCUMENTS 6,685,500 B2 * 2/2004 Nakamura ..... H01R 13/6271 439/352
6,722,913 B2 * 4/2004 Saka ..... H01R 13/641 439/352

(Continued)

FOREIGN PATENT DOCUMENTS

EP 1248328 A2 10/2002
EP 1 703 599 9/2006

(Continued)

OTHER PUBLICATIONS

European Search Report Dated Mar. 15, 2016.

*Primary Examiner* — Chandrika Prasad
(74) *Attorney, Agent, or Firm* — Gerald E. Hespos; Michael J. Porco; Matthew T. Hespos

(57) ABSTRACT

A connector has a slider (60) with a base (61) extending along a width direction and to be inserted below a lock arm (17). Two arms (62) project from opposite widthwise ends of the base (61). A coupling (63) couples projecting end parts of the arms (62) and faces an upper surface side of the lock arm (17). A deflectable initial position holding portion (76) is provided on the base (61) and is configured to regulate a movement of the slider (60) to a connection position by resiliently locking an initial position holding receiving portion (25) of a housing main body (11) at an initial position. A connection position holding portion (64) is provided on the coupling (63) and is configured to regulate a detachment of the slider (60) by contacting a connection position holding receiving portion (23) of the lock arm (17) at the connection position.

12 Claims, 12 Drawing Sheets

(58) Field of Classification Search
USPC ..... 439/352, 358, 752
See application file for complete search history.

(56) References Cited

U.S. PATENT DOCUMENTS

| | | | | |
|---|---|---|---|---|
| 2002/0022393 | A1* | 2/2002 | Saka | H01R 13/641 439/352 |
| 2003/0060078 | A1 | 3/2003 | Kashiyama | |
| 2009/0149054 | A1 | 6/2009 | Zheng | |
| 2016/0079705 | A1* | 3/2016 | Horiuchi | H01R 13/639 439/345 |
| 2016/0104965 | A1* | 4/2016 | Tanikawa | H01R 13/502 439/660 |

FOREIGN PATENT DOCUMENTS

| | | | |
|---|---|---|---|
| JP | 8-162215 | | 6/1996 |
| JP | 2002008779 | A | 1/2002 |
| JP | 2002-184526 | | 6/2002 |
| JP | 2006-253073 | | 9/2006 |
| JP | 2009-140675 | | 6/2009 |

* cited by examiner

CONNECTOR HAVING A HOUSING WITH A FITTING TUBE WITH GUIDE WALLS WITH A LOCK ARM INBETTWEEN

BACKGROUND

1. Field of the Invention

The present invention relates to a connector.

2. Description of the Related Art

A connector disclosed in Japanese Unexamined Patent Publication No. 2002-184526 includes first and second housings connectable to each other (called "male and female connectors" in Japanese Unexamined Patent Publication No. 2002-184526) and a slider (called a "front slider and a rear slider" in Japanese Unexamined Patent Publication No. 2002-184526) movably assembled with the first housing. A coil spring is incorporated into the slider. When a connecting operation is stopped in the process of connecting the first and second housings, a spring force of the coil spring accumulated thus far is released and the first and second housings are moved and biased in directions separating from each other, thereby preventing the first and second housings from being left in an incompletely connected state.

Further, the first housing includes a tubular receptacle into which the second housing is fittable, and an accommodating chamber capable of accommodating the slider is provided on a ceiling part of the receptacle. When the slider is accommodated into the accommodating chamber, the ceiling wall of the accommodating chamber is located above the slider and a holding portion (called a "butting portion" in Japanese Unexamined Patent Publication No. 2002-184526) is locked to a holding receiving portion (called a "locking step portion" in Japanese Unexamined Patent Publication No. 2002-184526) formed on the ceiling wall, thereby preventing a detachment of the slider from the first housing.

In the above case, since the ceiling wall is arranged to cover the slider from above, there is a problem of increasing a height of the connector by a thickness of the ceiling wall. Thus, although it is desired to omit the ceiling wall from the first housing, the holding receiving portion is also eliminated if the ceiling wall is merely omitted, wherefore a detachment of the slider cannot be prevented. This is an unfavorable situation.

The present invention was completed based on the above situation and aims to prevent a detachment of a slider while avoiding the enlargement of a connector.

SUMMARY

The present invention is directed to a connector with a second housing including a lock, a first housing connectable to the second housing, and a slider assembled with the first housing movably between an initial position and a connection position. The slider is configured to be moved from the initial position to the connection position as the first and second housings are connected properly. The first housing includes a housing main body configured so that the second housing can fit externally thereon. A lock arm is configured to form a deflection space between the lock arm and the housing main body and to hold the first and second housings in a connected state by resiliently locking the lock. The lock arm includes a connection position holding receiving portion on a surface on a side opposite to a surface facing the housing main body. The housing main body includes an initial position holding receiving portion on a surface facing the lock arm. The slider includes a base portion extending along a width direction and to be inserted into the deflection space, two arms projecting from opposite widthwise end parts of the base portion and a coupling that couples projecting end parts of the arms and facing the surface of the lock arm on the opposite side. An initial position holding portion is deflectably provided on the base portion and is configured to regulate a movement of the slider to the connection position by resiliently locking the initial position holding receiving portion at the initial position. A connection position holding portion is provided on the coupling and is configured to regulate a detachment of the slider by coming into contact with the connection position holding receiving portion at the connection position.

When the slider reaches the connection position, the connection position holding portion on the coupling of the slider contacts the connection position holding receiving portion of the lock arm to regulate a detachment of the slider. Further, when the slider is at the initial position, the initial position holding portion provided on the base portion of the slider resiliently locks the initial position holding receiving portion of the housing main body to regulate an inadvertent movement of the slider to the connection position.

Since the connection position holding receiving portion is not provided on a ceiling wall covering the slider in the above case, the ceiling wall can be omitted from the connector. Further, since the base portion is inserted into the deflection space, which is a dead space between the lock arm and the housing main body, it is not necessary to provide the connector with a dedicated insertion space for the base portion. Thus, the enlargement of the connector can be avoided.

The first housing includes two guide walls located at opposite widthwise sides of the lock arm and the two arms slide respectively on the guide walls to guide a movement of the slider. Since the movement of the slider is guided by the both arms that connect the coupling and the base portion, it is not necessary to provide the slider with a dedicated guide structure for guiding a movement. Thus, the configuration of the slider can be simplified.

The slider is formed into a frame shape as a whole by the base portion, the arms and the coupling, and the initial position holding portion projects into a frame defined by the slider. Since the entire slider is formed into the frame shape, the slider is structured to be excellent in shape stability. Further, since the initial position holding portion projects into the frame defined by the slider, the surrounding of the initial position holding portion is protected and a situation where the initial position holding portion is broken or fractured by interference with an external matter can be avoided.

The connection position holding receiving portion projects on a main body part of the lock arm, and the connection position holding portion is provided by recessing the coupling so that the connection position holding receiving portion is insertable therein. This prevents a contact state of the connection position holding portion and the connection position holding receiving portion from being released inadvertently at the connection position.

DETAILED DESCRIPTION

Figure 1:
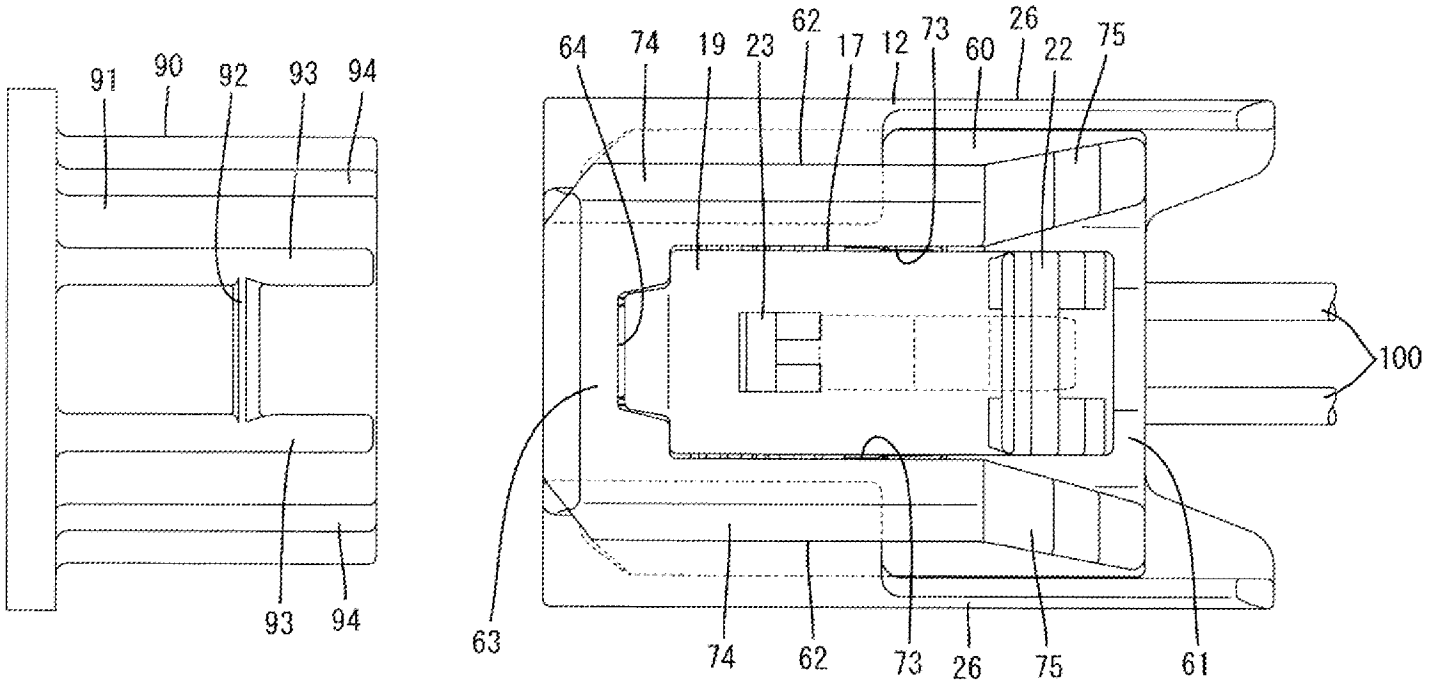
FIG. 1 is a plan view showing a state where first and second housings are arranged right opposite to each other in a connector of one embodiment.
Figure 2:
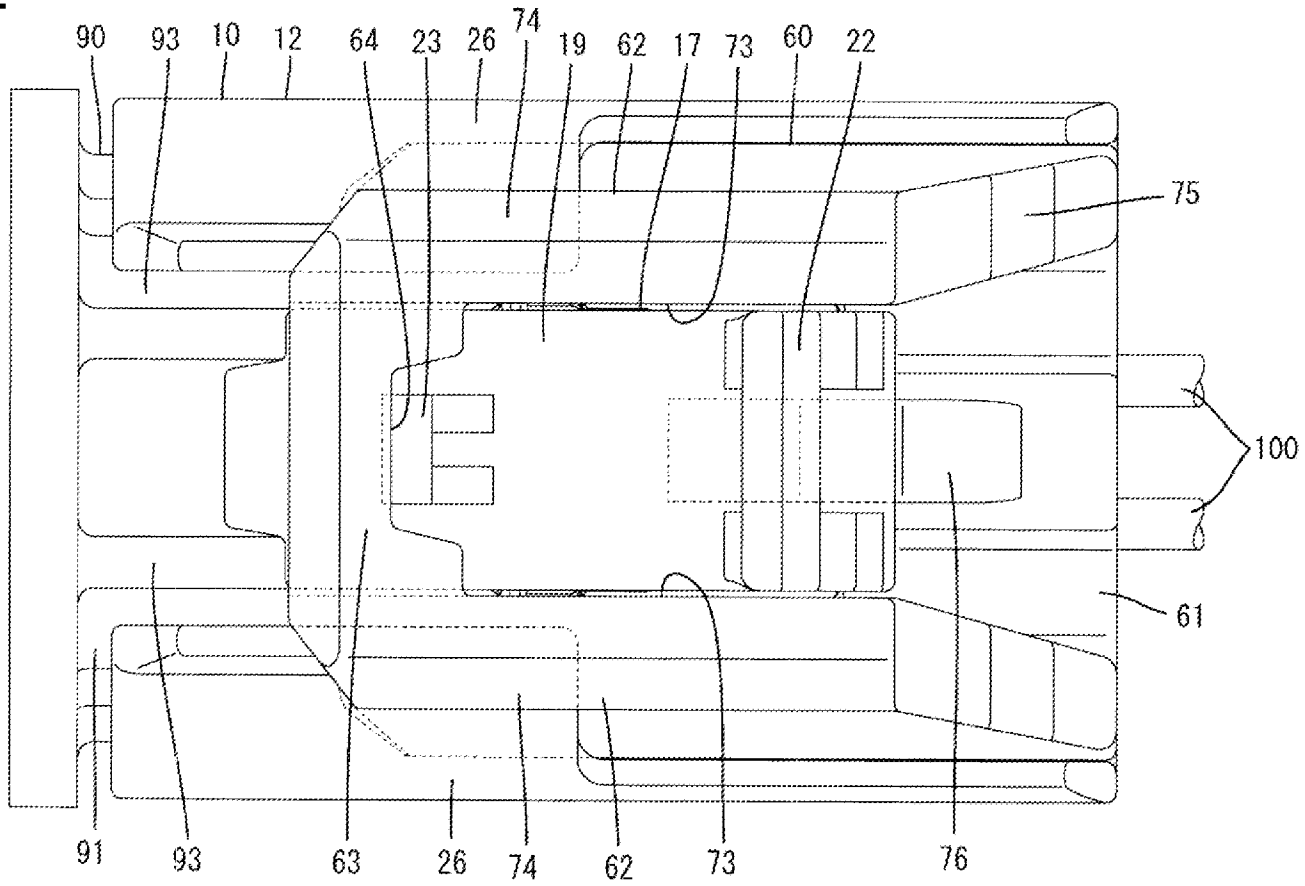
FIG. 2 is a plan view showing a state where the first and second housings are properly connected to each other.

One embodiment of the present invention is described with reference to FIGS. 1 to 12. This embodiment includes first and second housings 10, 90 connectable to each other, a slider 60 to be assembled with the first housing 10, spring members 80 to be assembled with the slider 60, first terminal fittings 20 to be mounted into the first housing 10 and second terminal fittings 99 to be mounted into the second housing 90. Note that, in the following description, connection surface sides of the first and second housings 10, 90 are referred to as front sides concerning a front-back direction and a vertical direction is based on FIG. 3.

Figure 3:
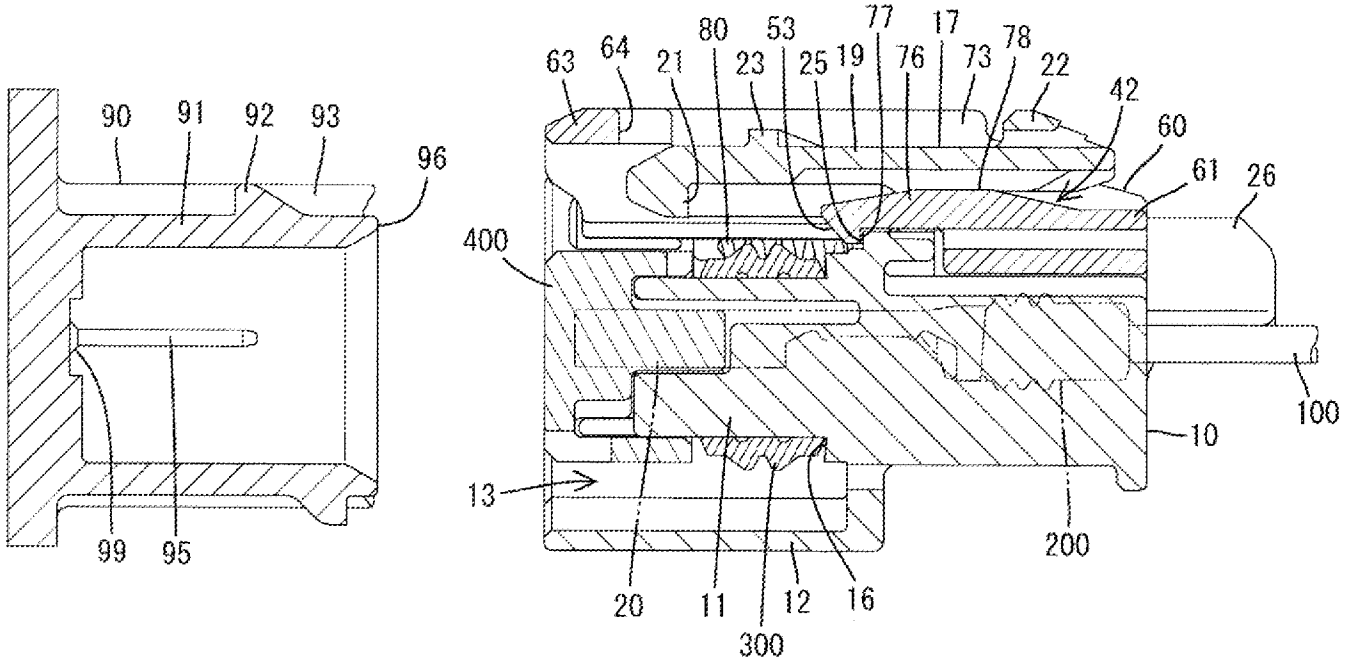
FIG. 3 is a section showing the state where the first and second housings are arranged right opposite to each other.
Figure 4:
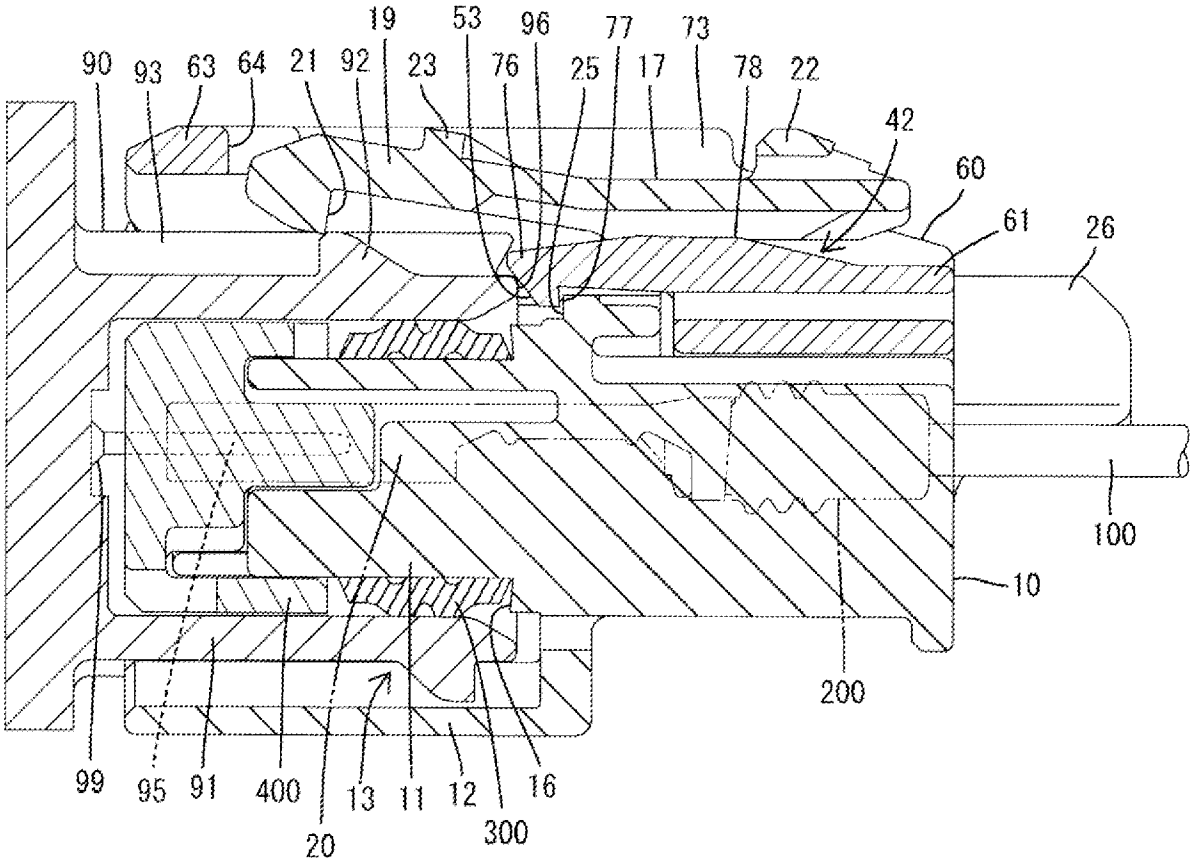
FIG. 4 is a section showing a state in a final stage of the process of connecting the first and second housings.

The second housing 90 is made of synthetic resin and includes, as shown in FIG. 3, a tubular receptacle 91. Tabs 95 of the second terminal fittings 99 are arranged to project into the receptacle 91. A lock portion 92 is provided to project on the upper surface of the upper wall of the receptacle 91. Further, as shown in FIG. 1, a pair of guide projections 93 are formed to extend in the front-back direction at opposite widthwise sides of the lock portion 92 on the upper surface of the upper wall of the receptacle 91 and, further, a pair of pressing portions 94 are formed to extend in the front-back direction at opposite outer sides of the both guide projections 93. As shown in FIG. 4, a releasing portion 96 capable of releasing locking between an initial position holding portion 76 and an initial position holding receiving portion 25 to be described later is formed on the opening edge of the front end of the upper wall of the receptacle 91.

Figure 7:
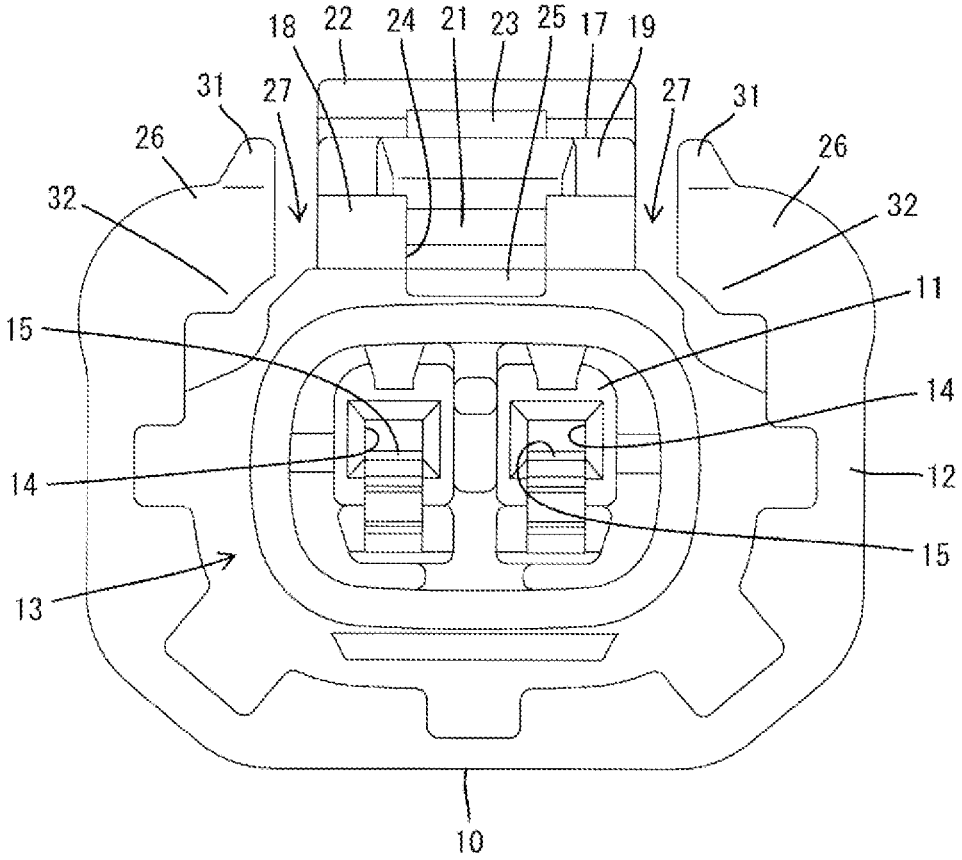
FIG. 7 is a front view of the first housing.

The first housing 10 is likewise made of synthetic resin and includes, as shown in FIGS. 3 and 7, a block-like housing main body 11 and a tubular fitting tube portion 12 surrounding the housing main body 11. A connection space 13 into which the receptacle 91 is fittable is formed to be open forward between the housing main body 11 and the fitting tube portion 12. A plurality of cavities 14 are formed to penetrate through the housing main body 11 in the front-back direction. In the case of this embodiment, as shown in FIG. 7, a pair of cavities 14 are arranged side by side and deflectable locking lances 15 are formed to project on the lower surfaces of the cavities 14. The first terminal fitting 20 is inserted into each cavity 14. As shown in FIG. 3, the first terminal fitting 20 is crimped and connected to a conductor part of a wire 100 and crimped and connected to a rubber plug 200 fitted on the wire 100. When being properly inserted into each cavity 14, the first terminal fitting 20 is resiliently locked and retained by the locking lance 15, the rubber plug 200 is inserted into a rear end part of the cavity 14 to seal the interior of the cavity 14 in a liquid-tight manner and the wire 100 is drawn out from the rear end of the housing main body 11.

Figure 5:
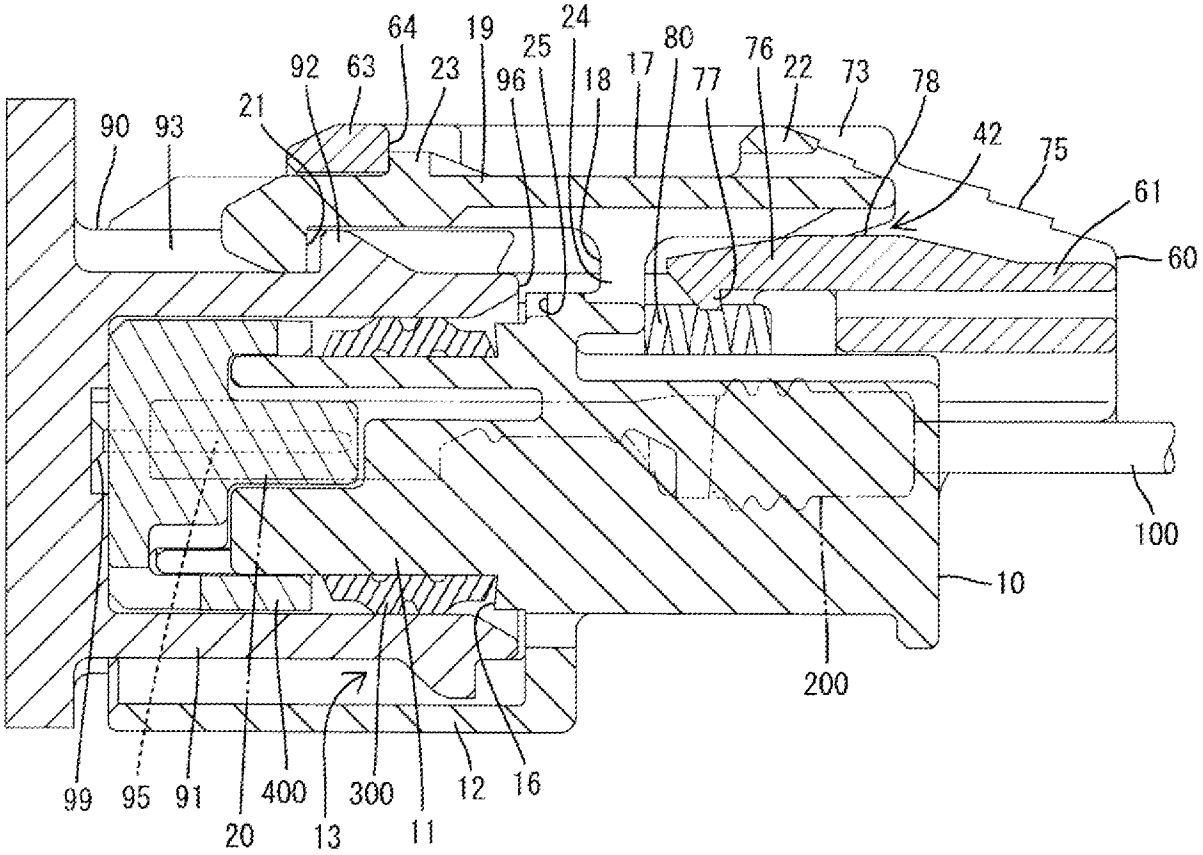
FIG. 5 is a section showing the state where the first and second housings are properly connected to each other.

As shown in FIG. 3, a step 16 is formed on the outer peripheral surface of the housing main body 11 and a front area before the step 16 is slightly recessed from a rear area behind the step 16. A seal ring 300 is fitted before the step 16 on the outer peripheral surface of the housing main body 11. As shown in FIG. 5, the receptacle 91 is inserted into the connection space 13 and the seal ring 300 is resiliently compressed between the receptacle 91 and the housing main body 11 at the time of connecting the first and second housings 10, 90, thereby sealing between the first and second housings 10, 90 in a liquid-tight manner.

As shown in FIG. 3, a cap-like front member 400 is mounted on a front end part of the outer peripheral surface of the housing main body 11. The above seal ring 300 is prevented from coming out forward by the front member 400.

Further, a lock arm 17 is coupled to the upper end of the outer peripheral surface of the housing main body 11 as shown in FIG. 5. The lock arm 17 includes an arm supporting point portion 18 standing upward from the outer peripheral surface of the housing main body 11 and an arm main body 19 extending both forward and backward from the upper end of the arm supporting point portion 18. A lock projection 21 is formed to project downward on a front end part of the arm main body 19 and a releasing portion 22 is formed to be slightly higher on a rear end part of the arm main body 19.

As shown in FIG. 4, the lock projection 21 interferes with the lock portion 92 and the arm main body 19 is deflected and deformed with the arm supporting point portion 18 as a supporting point in the process of connecting the first and second housings 10, 90. When the first and second housings 10, 90 are properly connected as shown in FIG. 5, the arm main body 19 resiliently returns, the lock projection 21 is arranged to be able to lock the lock portion 92 and the first and second housings 10, 90 are held in a connected state. On the other hand, in releasing the connected state of the first and second housings 10, 90, the releasing portion 22 is pushed down toward a deflection space 42 (see FIG. 3) located therebelow to separate the lock projection 21 from the lock portion 92 with the slider 60 pushed forward and retracted from the deflection space 42, whereby the first and second housings 10, 90 can be pulled apart from each other.

Figure 8:
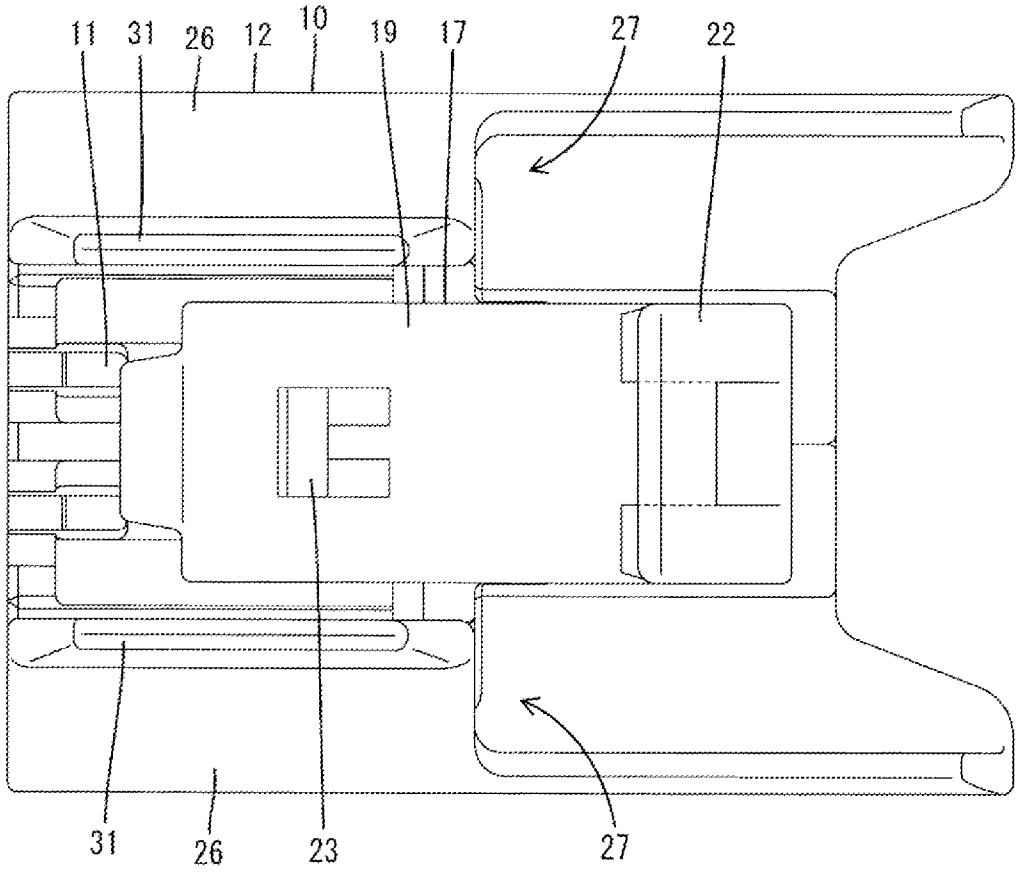
FIG. 8 is a plan view of the first housing.

Further, as shown in FIG. 5, a connection position holding receiving portion 23 for regulating a backward detachment of the slider 60 is formed on a front end part of the upper surface of the arm main body 19. As shown in FIG. 8, the connection position holding receiving portion 23 is in the form of a rib extending in a width direction. Further, as shown in FIG. 7, a through hole 24 is formed in a widthwise central part of the arm supporting point portion 18. As shown in FIG. 5, the initial position holding receiving portion 25 stepped from the upper surface of the housing main body 11 is formed below the through hole 24 on the arm supporting point portion 18 and behind the step 16. The later-described initial position holding portion 76 of the slider 60 can pass through the through hole 24 and a later-described locking projection 77 formed on a tip part of the initial position holding portion 76 passed through the through hole 24 is lockable to the initial position holding receiving portion 25 (see FIG. 3).

As shown in FIG. 8, a part of the upper wall of the fitting tube portion 12 facing the lock arm 17 is open and the upper surface of the lock arm 17 is exposed. Here, the upper wall of the fitting tube portion 12 includes a pair of guide walls 26 at opposite sides of the lock arm 17. The both guide walls 26 extend backward from the front end of the housing main body 11 and a guide space 27 for guiding a movement of the slider 60 is formed by the both guide walls 26 and the housing main body 11.

Rear parts of the both guide walls 26 have a substantially quarter-circular arcuate cross-section open upward and project further backward than the rear end of the housing main body 11. Front parts of the both guide walls 26 have a substantially quarter-circular arcuate cross-section open on a side facing the lock arm 17. As shown in FIG. 7, a pair of guide ribs 31 are formed to stand on the front parts of the both guide walls 26. The both guide ribs 31 extend in the front-back direction along the inner edges of the both guide walls 26 and are arranged at positions facing opposite widthwise ends of a front part of the arm main body 19.

Figure 6:
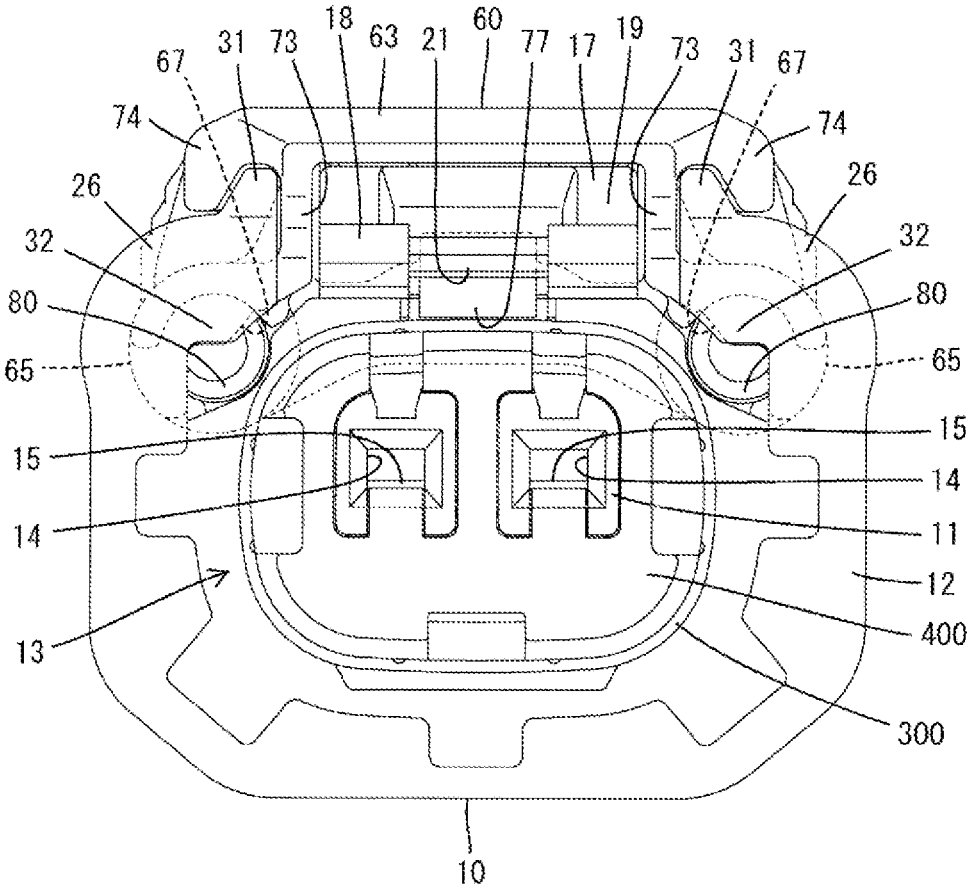
FIG. 6 is a front view of the connector.

Further, a pair of stopper walls 32 for closing a front side of the guide space 27 are formed to protrude on the front ends of the both guide walls 26 (see FIG. 6). The front end of the slider 60 comes into contact with the stopper walls 32, thereby regulating any further forward movement of the slider 60.

Next, the slider 60 is described. The slider 60 is inserted into the guide space 27 of the first housing and assembled with the first housing 10 movably in the front-back direction between an initial position (position shown in FIGS. 1, 3, 4 and 6) and a connection position (position shown in FIGS. 2 and 5) while sliding on the guide walls 26. Specifically, the slider 60 is made of synthetic resin, has a rectangular frame shape as a whole and includes a base portion 61 in the form of a plate piece extending along the width direction, a pair of arm portions 62 extending forward from opposite widthwise ends of the base portion 61 and a coupling portion 63 bridged between the front ends of the both arm portions 62 as shown in FIG. 9.

Figure 12:
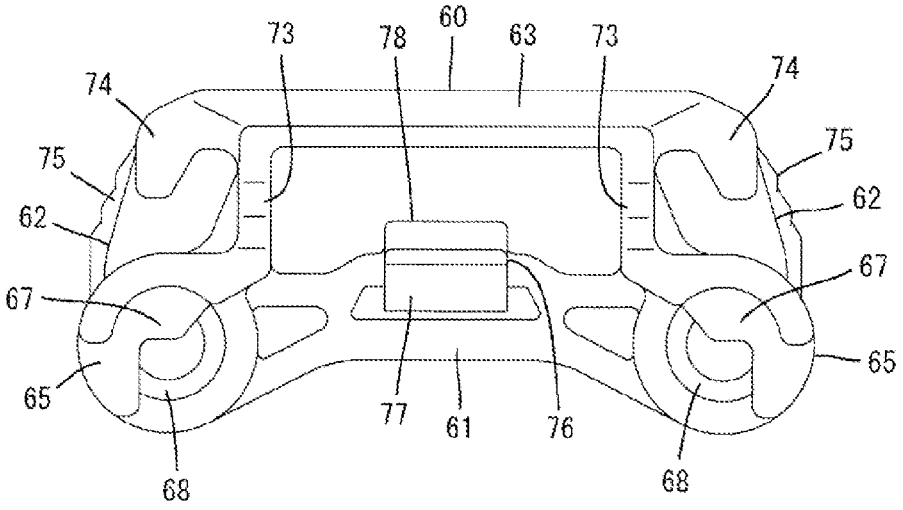
FIG. 12 is a front view of the slider.

The coupling portion 63 is located above the base portion 61 and arranged in an offset manner so as not to overlap the base portion 61 in a front view as shown in FIG. 12. Further, as shown in FIG. 3, when the slider 60 is assembled with the first housing 10, the base portion 61 is located on the side of the deflection space 42 located below the releasing portion 22 of the lock arm 17 and the coupling portion 63 is located on an upper surface side of the front end part of the lock arm 17.

Figure 9:
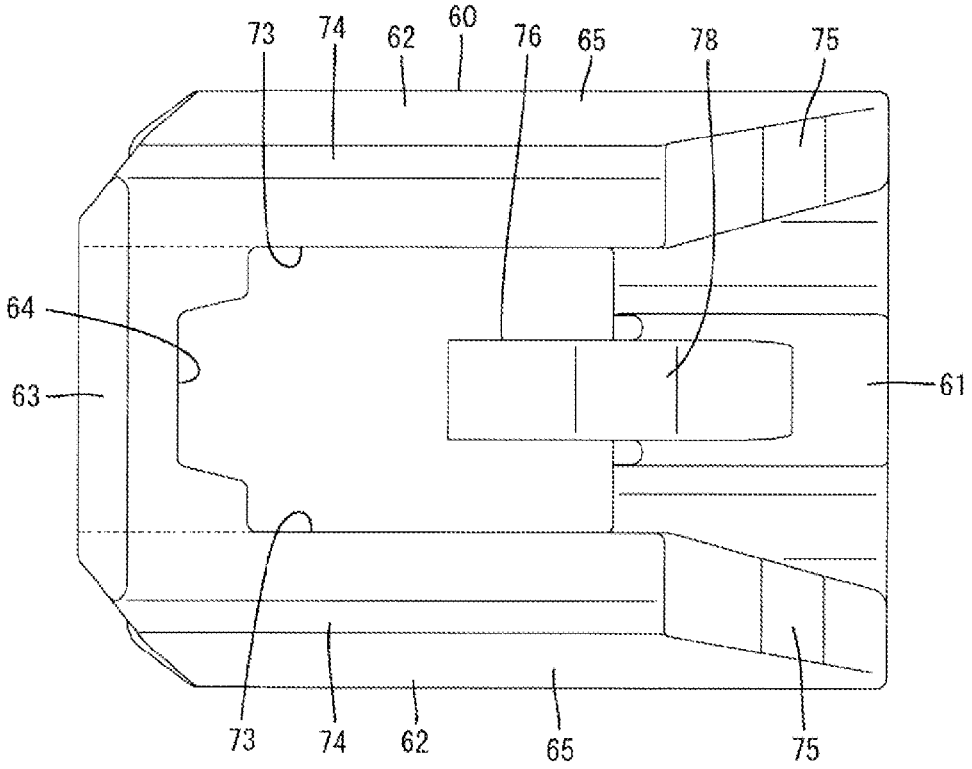
FIG. 9 is a plan view of a slider.

Further, as shown in FIG. 9, a connection position holding portion 64 substantially in the form of a rectangular recess is formed in a widthwise central part of the rear end of the coupling portion 63. As shown in FIG. 5, when the slider 60 is at the connection position, the connection position holding receiving portion 23 of the lock arm 17 is inserted into the connection position holding portion 64 to rest thereon.

Figure 10:
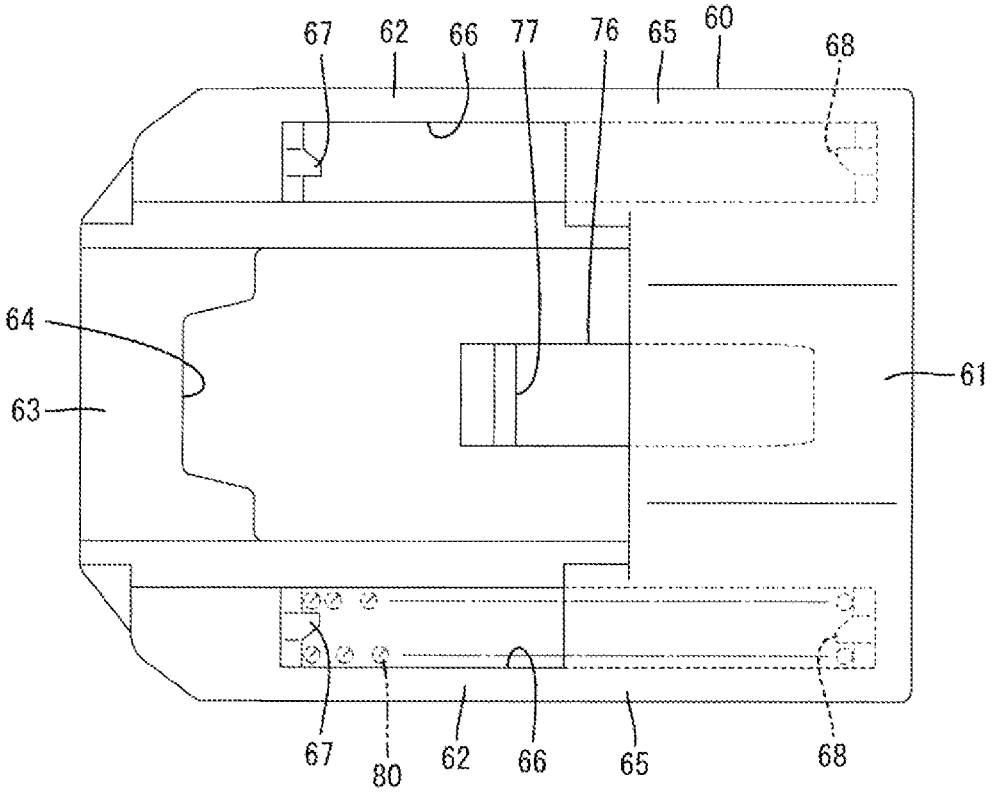
FIG. 10 is a bottom view of the slider.

As shown in FIG. 10, a pair of spring accommodating portions 65 capable of accommodating the spring members 80 are formed below the both arm portions 62. Note that the spring member 80 is formed by a known spring such as a compression coil spring and resiliently expandable and contractible in the front-back direction.

The spring accommodating portion 65 is formed into a substantially hollow cylindrical shape and the spring member 80 can be entirely accommodated therein. The spring accommodating portion 65 includes first and second spring receiving portions 67, 68 on front and rear sides for receiving and supporting opposite front and rear ends of the spring member 80. As shown in FIG. 12, the first and second spring receiving portions 67, 68 are arranged at positions not overlapping each other in a front view in consideration of the removal of a forming mold for the slider 60 in the front-back direction. Further, as shown in FIG. 10, an opening portion 66 open inward and downward is formed in a front part of the spring accommodating portion 65.

When the spring member 80 is mounted into the spring accommodating portion 65 as shown in FIG. 6, a lower part of the front end of the spring member 80 is arranged in an exposed manner below the first spring receiving portion 67. This causes the pressing portions 94 of the second housing 90 to be introduced into the opening portions 66 while pushing the lower parts of the front ends of the spring members 80 in the process of connecting the first and second housings 10, 90. Further, the second spring receiving portion 68 can receive a spring force of the spring member 80 by coming into contact with the lower part of the front end of the spring member 80.

As shown in FIG. 12, the both arm portions 62 are formed with a pair of protection walls 73 standing substantially vertically upward from the spring accommodating portions 65. As shown in FIG. 6, in the case of assembling the slider 60 with the first housing 10, the both protection walls 73 are located to cover opposite widthwise ends of the lock arm 17.

Further, pair of guide main bodies 74 capable of guiding a movement of the slider 60 are formed on upper end parts of the both arm portions 62. The guiding main bodies 74 have such a substantially arcuate cross-section as to protrude outwardly from the upper ends of the both protection walls 73 and then hang downwardly. When the slider 60 is assembled with the first housing 10, the guide ribs 31 are fitted and inserted into between the guiding main bodies 74 and the protection walls 73 as shown in FIG. 6. In the process of moving the slider 60, the guide ribs 31 slide on the guiding main bodies 74 and the protection walls 73, thereby guiding a movement of the slider 60.

Figure 11:
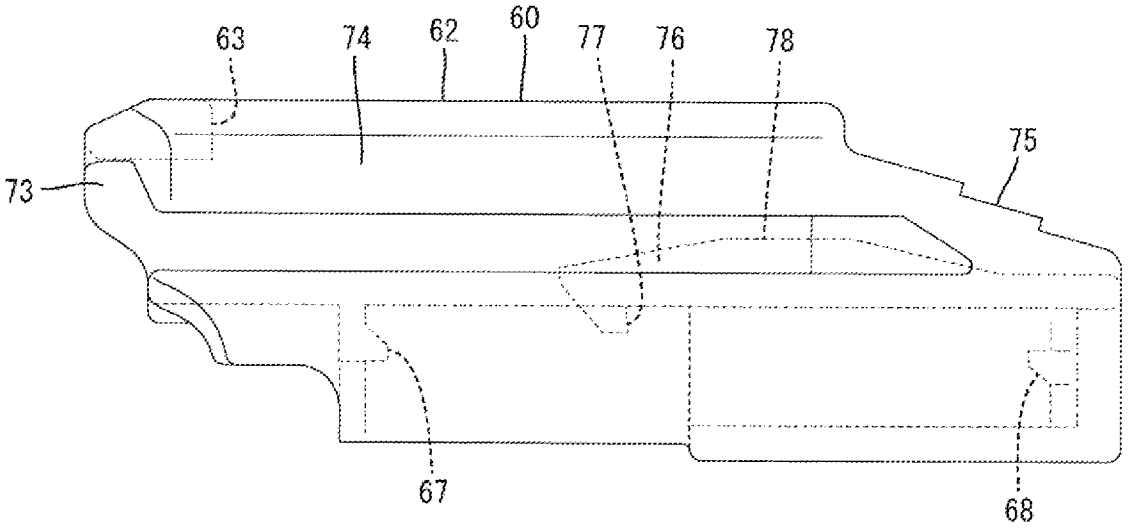
FIG. 11 is a side view of the slider.

Further, as shown in FIG. 11, push-in portions 75 inclined upwardly in a step-like manner from the rear end toward a front side are formed on the rear ends of the both arm portions 62. The push-in portions 75 are pressed forward, whereby the slider 60 can be moved toward the initial position.

The initial position holding portion 76 capable of regulating a movement of the slider 60 to the connection position is deflectably formed on the base portion 61. As shown in FIG. 9, the initial position holding portion 76 is cantilevered forward from a widthwise central part of the upper surface of the base portion 61. As shown in FIG. 11, the locking projection 77 is formed to project downward on the tip part of the initial position holding portion 76. As shown in FIG. 3, the locking projection 77 is hooked and locked to the initial position holding receiving portion 25 when the slider 60 is at the initial position. Further, an inclined surface 53 inclined obliquely downwardly is formed on the front surface of the tip part of the initial position holding portion 76. Further, the initial position holding portion 76 includes a base-like thickened portion 78 formed by gradually increasing a thickness of an upper part from a base end part coupled to the base portion 61 to a substantially central area in the front-back direction.

The structure of the connector of this embodiment is as described above. Next, an assembling method and a connecting operation of the connector are described.

First, the spring members 80 are accommodated into the spring accommodating portions 65 of the slider 60. The spring members 80 are inserted into the spring accommodating portions 65 through the opening portions 66. Then, the front ends of the spring members 80 are supported on the first spring receiving portions 67 and the rear ends of the spring members 80 are supported on the second spring receiving portions 68.

Subsequently, the slider 60 is inserted into the guide space 27 of the first housing 10 from behind. In the process of inserting the slider 60, the base portion 61 is located in the deflection space 42 below the releasing portion 22 of the lock arm 17, the protection walls 73 enter clearances between the guide walls 26 and the lock arm 17, and the coupling portion 63 is located above the arm main body 19. When the slider 60 is properly assembled, the initial position holding portion 76 passes through the through hole 24 and, as shown in FIG. 3, the locking projection 77 is arranged to be lockable to the initial position holding receiving portion 25 to prevent a backward detachment of the slider 60. Further, when the slider 60 is properly assembled, the front ends of the spring accommodating portions 65 are arranged to be able to come into contact with the stopper walls 32 to regulate a forward displacement of the slider 60. In this way, the slider 60 is held at the initial position with respect to the first housing 10 with forward and backward movements thereof regulated.

Note that the front and rear ends of the spring members 80 are supported on the first and second spring receiving portions 67, 68 when the slider 60 is at the initial position. Further, at the initial position, the thickened portion 78 is located before the deflection space 42 on the side of the releasing portion 22 on the lock arm 17, thereby enabling the deflection of the lock arm 17. Furthermore, with the slider 60 assembled with the first housing 10, the upper surfaces of the base portion 61 and the both arm portions 62 are arranged in an exposed manner substantially at the same height positions as the upper end of the releasing portion 22.

Subsequently, the receptacle 91 of the second housing 90 is fitted into the connection space 13 of the first housing 10. In the connecting process, the pressing portions 94 of the second housing 90 enter the spring accommodating portions 65 to come into contact with the lower parts of the front ends of the spring members 80. As the connection further progresses, the front ends of the spring members 80 are pressed by the pressing portions 94 to be separated from the first spring receiving portions 67 and the spring members 80 are resiliently compressed while being supported on the second spring receiving portions 68. During this time, the spring members 80 accumulate their spring forces while applying the spring forces to the slider 60.

Further, as shown in FIG. 4, the releasing portion 96 of the second housing 90 comes into contact with the tip part of the initial position holding portion 76 and slides on the inclined surface 53 in a final stage of the connecting process of the first and second housings 10, 90 and, associated with that, the initial position holding portion 76 is deflected and deformed with the base end part thereof as a supporting point.

Thereafter, when the first and second housings 10, 90 reach a proper connection position, the lock arm 17 is resiliently locked to the lock portion 92 and the first and second housings 10, 90 are retained and held as shown in FIG. 5. Simultaneously, the first and second terminal fittings 20, 99 are properly connected to each other.

Further, when the first and second housings 10, 90 reach the proper connection position, locking between the locking projection 77 of the initial position holding portion 76 and the initial position holding receiving portion 25 is released. Associated with that, the spring forces accumulated in the spring members 80 are released and the spring members 80 are going to return to a natural state. According to such returning movements of the spring members 80, the second spring receiving portions 68 of the slider 60 are pressed by the spring members 80 and the entire slider 60 is moved backward.

In the process of moving the slider 60, the spring accommodating portions 65 slide on the inner surfaces of the guide walls 26 and the guide ribs 31 slide on the protection walls 73 and the guiding main bodies 74, thereby guiding the movement of the slider 60. When the slider 60 reaches the connection position as shown in FIG. 5, the spring members 80 substantially return to the natural state and the connection position holding receiving portion 23 of the lock arm 17 comes into contact with the connection position holding portion 64 of the slider 60, thereby regulating any further retracting movement of the slider 60. By visually confirming that the slider 60 has reached the connection position in this way, it can be known that the first and second housings 10, 90 are in a properly connected state.

When the slider 60 is at the connection position, the thickened portion 78 is located in the deflection space 42 on the side of the releasing portion 22 of the lock arm 17 and arranged in proximity to the lower surface of the lock arm 17 on the side of the releasing portion 22 as shown in FIG. 5. Even if an external matter (including a finger) accidentally comes into contact with the releasing portion 22 of the lock arm 17 from above in this state, the lock arm 17 comes into contact with the thickened portion 78, whereby any further deflection is regulated to prevent the releasing portion 22 from being operated inadvertently operated for unlocking.

On the other hand, if the connecting operation is stopped before the first and second housings 10, 90 reach the properly connected state, the pressing portions 94 are pushed back by the spring forces of the spring members 80 accumulated in the connecting process and the first and second housings 10, 90 are separated from each other. This prevents the first and second housings 10, 90 from being left in an incompletely connected state.

Further, in separating the first and second housings 10, 90 from each other for maintenance or the like, the push-in portions 75 are first pressed with fingers to push the slider 60 forward. Then, the spring members 80 are resiliently compressed and the pressing portions 94 are pressed by the spring members 80. As the slider 60 moves forward, the thickened portion 78 is retracted from its position below the releasing portion 22 and the deflection of the lock arm 17 is permitted. If the releasing portion 22 is pressed to lift up the front end part of the lock arm 17 in that state, the lock projection 21 is separated from the lock portion 92. As the locking state of the lock arm 17 is released in this way, the spring members 80 press the pressing portions 94 forward and the first housing 10 is separated from the second housing 90 by those pressing forces (spring forces).

As described above, when the slider 60 reaches the connection position, the connection position holding portion 64 provided on the coupling portion 63 of the slider 60 comes into contact with the connection position holding receiving portion 23 of the lock arm 17 to prevent a detachment of the slider 60. Further, when the slider 60 is at the initial position, the initial position holding portion 76 provided on the base portion 61 of the slider 60 resiliently locks the initial position holding receiving portion 25 of the housing main body 11 to regulate an inadvertent movement of the slider 60 to the connection position. In this case, the connection position holding receiving portion 23 is not provided on a ceiling wall covering the slider 60 unlike before and the ceiling wall is omitted from the connector. Further, the base portion 61 is inserted into the deflection space 42, which is a dead space between the lock arm 17 and the housing main body 11, and an accommodation space for the base portion 61 is not specially provided in the connector. Thus, the enlargement of the connector can be avoided.

Further, since the movement of the slider 60 is guided by the guiding main bodies 74 formed on the both arm portions 62 connecting the coupling portion 63 and the base portion 61, it is not necessary to provide the slider 60 with a dedicated guide structure for guiding a movement separately from the both arm portions 62 and the configuration of the slider 60 can be simplified.

Further, since the entire slider 60 is formed into a frame shape, the slider 60 is excellent in shape stability. In addition, since the initial position holding portion 76 projects into a frame defined by the slider 60, the surrounding of the initial position holding portion 76 is protected and a situation where the initial position holding portion 76 is broken or fractured due to interference with an external matter is avoided.

Furthermore, since the connection position holding receiving portion 23 projects on the arm main body 19 of the lock arm 17 and the connection position holding portion 64 is provided by recessing the coupling portion 63, it is prevented that a contact state of the connection position holding portion 64 and the connection position holding receiving portion 23 is inadvertently released at the connection position.

The present invention is not limited to the above described and illustrated embodiment. For example, the following modes are also included in the technical scope of the present invention.

The spring members may be interposed between the first housing and the slider.

The slider may be configured to move forward from the initial position toward the connection position.

A locking recess may be formed instead of the locking projection on the tip part of the initial position holding portion and the initial position holding receiving portion may be in the form of a projection hookable to the locking recess instead of in the form of a recess.

Conversely to the above embodiment, the connection position holding portion may project on the coupling portion of the slider and the connection position holding receiving portion may be provided by recessing the tip part of the lock arm so that the projection-like connection position holding portion is insertable thereinto.

LIST OF REFERENCE SIGNS

10 . . . first housing
11 . . . housing main body
17 . . . lock arm
23 . . . connection position holding receiving portion
25 . . . initial position holding receiving portion
42 . . . deflection space
60 . . . slider
61 . . . base portion
62 . . . arm portion
63 . . . coupling portion
64 . . . connection position holding portion
76 . . . initial position holding portion
80 . . . spring member
90 . . . second housing
91 . . . receptacle
92 . . . lock portion
96 . . . releasing portion

The invention claimed is:

1. A connector, comprising:

a second housing including a lock portion;

a first housing connectable to the second housing; and a slider assembled with the first housing movably between an initial position and a connection position and configured to be moved from the initial position to the connection position as the first and second housings are properly connected;

wherein:

the first housing includes a housing main body configured such that the second housing is externally fittable thereon, a fitting tube spaced out from the housing main body and partly surrounding the second housing when the second housing is fit externally on the housing main body, the fitting tube including opposed spaced apart guide walls, and a lock arm connected to the housing main body and exposed outward of the first housing at a position between the guide walls, the lock arm being configured to form a deflection space between the lock arm and the housing main body and to hold the first and second housings in a connected state by resiliently locking the lock portion;

the lock arm includes a connection position holding receiving portion on a surface of the lock arm facing away from the housing main body;

the housing main body includes an initial position holding receiving portion on a surface facing the lock arm;

the slider includes a base portion extending along a width direction and to be inserted into the deflection space, two arms projecting from opposite widthwise end parts of the base portion and a coupling that couples projecting end parts of the arms and facing the surface of the lock arm facing away from the housing main body;

an initial position holding portion on the base portion of the slider and configured to regulate a movement of the slider to the connection position by resiliently locking the initial position holding receiving portion at the initial position; and a connection position holding portion on the coupling of the slider and configured to contact the connection position holding receiving portion on the surface of the lock arm facing away from the housing to regulate detachment of the slider at the connection position.

2. The connector of claim 1, wherein the arms of the slider slide respectively on the guide walls of the first housing to guide a movement of the slider.

3. The connector of claim 2, wherein the slider is formed into a frame shape as a whole by the base portion, the arms and the coupling, and the initial position holding portion projects into the frame shape defined by the slider.

4. The connector of claim 3, wherein the connection position holding receiving portion projects on a main body part of the lock arm, and the connection position holding portion is provided by recessing the coupling so that the connection position holding receiving portion is insertable therein.

5. The connector of claim 1, wherein the slider is formed into a frame shape as a whole by the base portion, the arms and the coupling, and the initial position holding portion projects into the frame shape defined by the slider.

6. The connector of claim 5, wherein the connection position holding receiving portion projects on a main body part of the lock arm, and the connection position holding portion is provided by recessing the coupling so that the connection position holding receiving portion is insertable therein.

7. The connector of claim 1, wherein the connection position holding receiving portion projects on a main body part of the lock arm, and the connection position holding portion is provided by recessing the coupling so that the connection position holding receiving portion is insertable therein.

8. A connector, comprising:

a first housing with a housing main body, a fitting tube spaced out from the housing main body and partly surrounding the housing main body, the fitting tube including opposed spaced apart guide walls, and a lock arm connected to the housing main body and exposed outward of the first housing at a position between the guide walls, the lock arm being configured to form a deflection space between the lock arm and the housing main body, the lock arm includes a connection position holding receiving portion on a surface of the lock arm facing away from the housing main body, and an initial position holding receiving portion formed on a surface of the housing main body facing the lock arm;

a second housing connectable to the first housing and including a lock portion that is engaged by the lock arm when the first and second housings are in a properly connected state; and a slider assembled with the first housing movably between an initial position and a connection position and configured to be moved from the initial position to the connection position as the first and second housings are connected properly, the slider includes:

a base extending along a width direction and to be inserted into the deflection space, two arms projecting from opposite widthwise sides of the base, a coupling that couples projecting end parts of the arms and facing the surface of the lock arm facing away from the housing main body, an initial position holding portion on the base of the slider and configured to regulate a movement of the slider to the connection position by resiliently locking the initial position holding receiving portion at the initial position, and a connection position holding portion on the coupling of the slider and configured to contact the connection position holding receiving portion on the surface of the lock arm facing away from the housing to regulate detachment of the slider at the connection position.

9. The connector of claim 8, wherein the first housing has a front end connectable to the second housing and a rear end opposite the front end, the lock arm being connected to the housing main body by a supporting portion between the front and rear ends.

10. The connector of claim 9, wherein the initial position holding receiving portion is at a position on the first housing between the front end and the supporting portion that connects the lock arm to the housing main body.

11. The connector of claim 10, wherein the connection position holding receiving portion is formed on the lock arm at a position between the supporting portion that connects the lock arm to the housing main body and the front end of the first housing.

12. The connector of claim 11 wherein the second housing is fit externally on a portion of the first housing between the front end of the first housing and the supporting portion that connects the lock arm to the housing main body.

* * * * *